US005732626A

United States Patent [19]

Karakida

[11] Patent Number: 5,732,626

[45] Date of Patent: Mar. 31, 1998

[54] APPARATUS FOR REGISTRATION PLATE CYLINDERS

[75] Inventor: Kimio Karakida, Shizuoka, Japan

[73] Assignee: Shinohara Michinery Co., Ltd., Shizuoka, Japan

[21] Appl. No.: 814,266

[22] Filed: Mar. 10, 1997

[51] Int. Cl.[6] ..... B41F 13/14; B41F 13/20

[52] U.S. Cl. ..... 101/248

[58] Field of Search ..... 101/248, 181, 101/247, 136, 138, 141, 180, 183; 384/264, 263; 74/395, 397, 406, 412 R, 420, 431, 413

[56] References Cited

U.S. PATENT DOCUMENTS 3,717,092 2/1973 Crum ..... 101/248
3,750,568 8/1973 Weisgerber ..... 101/181
5,083,511 1/1992 Hertel et al. ..... 101/248 X

FOREIGN PATENT DOCUMENTS 323944 1/1991 Japan .

*Primary Examiner*—J. Reed Fisher
*Attorney, Agent, or Firm*—Ladas & Parry

[57] ABSTRACT

A registering apparatus for plate cylinders, comprising a helical tooth-carrying driving gear (16) mounted nonrotatably and slidably on an end portion of a cylinder shaft (10) at a driving side of a plate cylinder and meshed with a helical tooth-carrying driving gear (24) on a blanket cylinder, first crank arms (32) engaged with an end portion of the shaft (10) so as to apply a thrust in the axial direction of the shaft (10) and adapted to be pushed by a first thrust means (40), and second crank arms (34) engaged with a side portion of the driving gear (16) so as to apply a thrust to the plate cylinder in the axial direction thereof and adapted to be pushed by a second thrust means (46).

1 Claim, 4 Drawing Sheets

APPARATUS FOR REGISTRATION PLATE CYLINDERS

BACKGROUND OF THE INVENTION

1. Field of the Invention

This invention relates to a sheet-fed printing press, and more particularly to an apparatus for registration of plate cylinders, which is adapted to correct a registration error ascribed to the incorrect positioning of a plate cylinder.

2. Description of the Prior Art

In a multicolor sheet-fed printing press, a form plate is wound around each of the plate cylinders corresponding to required colors, and the printing is carried out in sequence of color. Unless the colors are printed sequentially on correct portions of one sheet of paper during this time, they become out of register, and good-quality printed matter cannot be obtained.

In order to obtain a correct register for each color, crisscross marks called generally register marks are printed on a marginal portion of a sheet of paper. The printed position of the register mark for each color is measured. When a deviation of a color from another is found, a registration for a plate cylinder or a form plate is carried out on the assumption that there is a plate cylinder positioned incorrectly to an extent that corresponds to an amount of the deviation.

It should be discussed from various aspects whether to make an adjustment of a plate cylinder, which corresponds to each color, or whether to make an adjustment of a form plate on an outer circumferential surface of the plate cylinder, in accordance with an amount of the deviation. The present invention relates to the techniques for registration of a plate cylinder itself. The reason resides in that, although an adjustable amount is small as compared with that by the techniques for registration of a form plate, the apparatus can be formed to a simpler construction.

The register errors in paper printing are classified into parallel register errors caused by a parallel deviation of a plate cylinder from another in the vertical/lateral direction of a sheet of paper, and register errors caused by a combination of lateral and vertical deviations of a plate cylinder from another. The present invention is directed to the techniques for eliminating a parallel register error only.

Japanese Patent Laid-Open No. 23944/1991 discloses a registering apparatus shown in FIG. 4. In this apparatus, a driving gear 106 having helical teeth and mounted on a shaft 102 of a plate cylinder 100 via a bearing 104 is meshed with a gear 112 having helical teeth and supported on a support pin 110 fixed to a frame 108 of a printer, and this gear 112 is joined nonrotatably to a gear 114 having flat teeth. This flat tooth-carrying gear 114 drives a flat tooth-carrying gear 116 mounted nonrotatably on the shaft 102.

The plate cylinder 100 can be moved axially by a spindle 118, whereby a registration in the lateral direction of a sheet of paper is made. In the meantime, the flat tooth-carrying gear 114 and helical tooth-carrying gear 112 are moved in the axial direction of the support pin 110 by another spindle 120. During this time, the helical tooth-carrying gear 112 is rotated, and the rotation thereof is transmitted to the plate cylinder 100 via the gears 114, 116 to cause the plate cylinder to be also rotated, a registration in the vertical direction of a sheet of paper being thereby made.

In a case where a plate cylinder is cocked for the purpose of eliminating a combined deviation mentioned above of a printing position from a proper position, a case where the touching condition of bearers on the side portions of a plate cylinder and a blanket cylinder is changed for the purpose of regulating the condition of arrangement of the cylinders, and a case where a printing cylinder cleaning operation is carried out, it is necessary to move the plate cylinder with respect to the frame of the printer (move the cylinder shaft by an eccentric bearing).

However, in these conventional techniques, various members including the gears 112, 114 and spindles 118, 120 which constitute the registering apparatus are substantially in a fixed state with respect to the frame 108, so that the plate cylinder 100 does not have movability at all. An adjustment amount in the axial/rotational direction of the plate cylinder 100 is not clear, and has a low reproducibility. Moreover, an undue load is imparted to a specific member (gear 112 united with the member 114).

SUMMARY OF THE INVENTION

The present invention has been developed in view of these problems, and provides an advanced registering apparatus for plate cylinders. An object of the present invention is to have a plate cylinder made movable irrespective of the provision of a registering apparatus, form a registering apparatus to a simple construction, and make it possible to carry out registration easily.

To achieve this object, the registering apparatus for plate cylinders according to the present invention is provided with a helical tooth-carrying driving gear 16 mounted nonrotatably/slidably on an end portion of a shaft 10 at a driving side of a plate cylinder, this driving gear 16 being meshed with a similar helical tooth-carrying driving gear 24 on a blanket cylinder, first crank arms 32 being engaged with an end portion of the shaft 10 so as to apply a thrust in the axial direction of the shaft 10 and adapted to be pushed by a first thrust means 40, second crank arms 34 being engaged with a side portion of the driving gear 16 so as to apply a thrust to the plate cylinder in the axial direction thereof and adapted to be pushed by a second thrust means 46.

When the first crank arms 32 are turned by the first thrust means 40, the axial position of the plate cylinder is regulated, whereby a lateral registration of paper is made concerning the printed results. Since the driving gear 16 is set slidable with respect to the cylinder shaft 10, it does not receive any force during this time.

When the second crank arms 34 are turned by the second thrust means 46, the driving gear 16 is pushed in the axial-direction of the plate cylinder, and, during this time, the driving gear 16 and the driving gear 24 on the blanket cylinder are rotated with the plate cylinder since both of these driving gears have helical teeth. Regarding the printed results, a registration in the vertical-direction of the sheet of paper is thereby made. During this time, the axial position of the plate cylinder does not vary since the driving gear 16 is axially slidable, though it is rotated.

Another object of the present invention will become apparent from the following descriptions given with reference to the drawings. However, these descriptions are merely of an embodiment of the present invention, and the present invention is not limited to the embodiment.

DESCRIPTION OF THE PREFERRED EMBODIMENT

Figure 1:
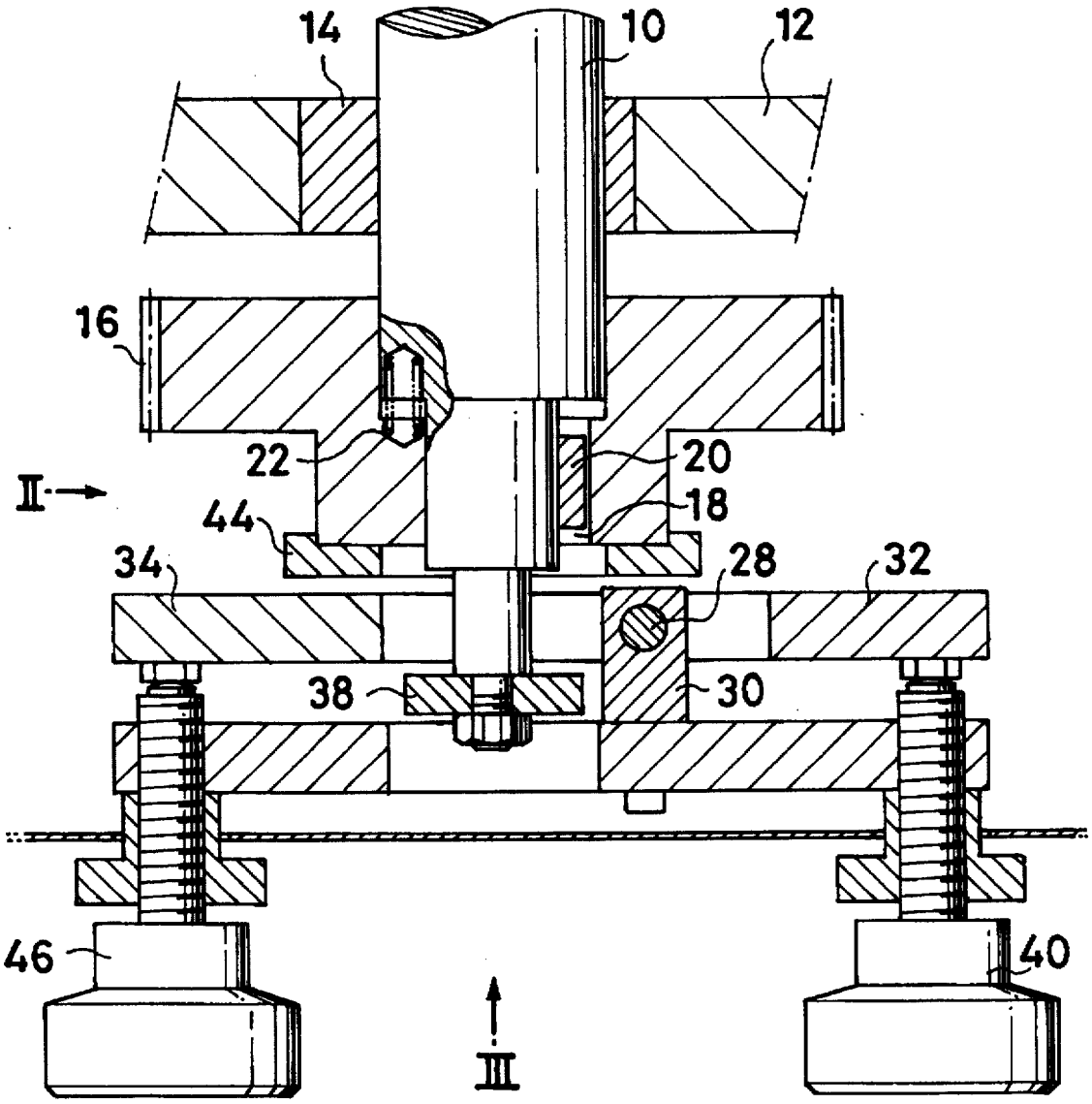
FIG. 1 is a sectional view in plan showing an embodiment of the registering apparatus for plate cylinders according to the present invention.

A plate cylinder, a subject of registration is shown representatively by its shaft 10 alone. In a general printing press, it is known that printing cylinders comprise a plate cylinder, a blanket cylinder, a pressure cylinder and a sheet transfer cylinder, and that various kinds of rollers constituting an ink supply member and a wetting water supply member are additionally provided.

The shaft 10 of the plate cylinder is rotatably supported on a pair of frames 12 at both sides of the printing press via a bearing 14. This bearing 14 may comprise a regular flat bearing, and will comprise an eccentric bearing shown in the drawings when the moving of the plate cylinder with respect to the frames 12 is taken into consideration as mentioned above. The techniques for moving a plate cylinder, which is supported on an eccentric bearing, as necessary have also already been known well.

A helical tooth-carrying driving gear 16 is mounted on an end portion of the cylinder shaft 10. This driving gear 16 is adapted to receive torque from a driving motor (not shown) in a printing press via various kinds of gears and rotate the plate cylinder in a time-regulating manner. The driving gear 16 is rendered non-rotatable with respect to the cylinder shaft 10 by a key 20 fitted in a key way 18, and slidable in the axial direction of the cylinder shaft. The driving gear is urged constantly in the direction of a side portion thereof by a spring member 22 provided between the driving gear and cylinder shaft 10.

The driving gear 16 on the shaft of the plate cylinder is meshed with a driving gear 24 on the shaft of a blanket cylinder which is in contact at a circumferential portion thereof with the plate cylinder, and this driving gear 24 also has helical teeth, of course. The techniques for vertical registration of a sheet by slightly turning the plate cylinder by utilizing a helix angle of the driving gears 16, 24 thus meshed with each other at the helical teeth thereof have already been known from, for example, Japanese Patent Laid-Open No. 126927/1994.

The substantial characteristics of the present invention are found in the following construction. An arm shaft 28 is provided on a mount base 26 fixed to the frame 12, via a shaft support member 30. This arm shaft 28 constitutes the center of pivotal movement common to first and second crank arms 32, 34. The centers of rotation of both crank arms 32, 34 may, of course, be provided separately but, when a common center is provided as shown in the drawings, the space can be saved, and the apparatus can be designed compactly.

Figure 2:
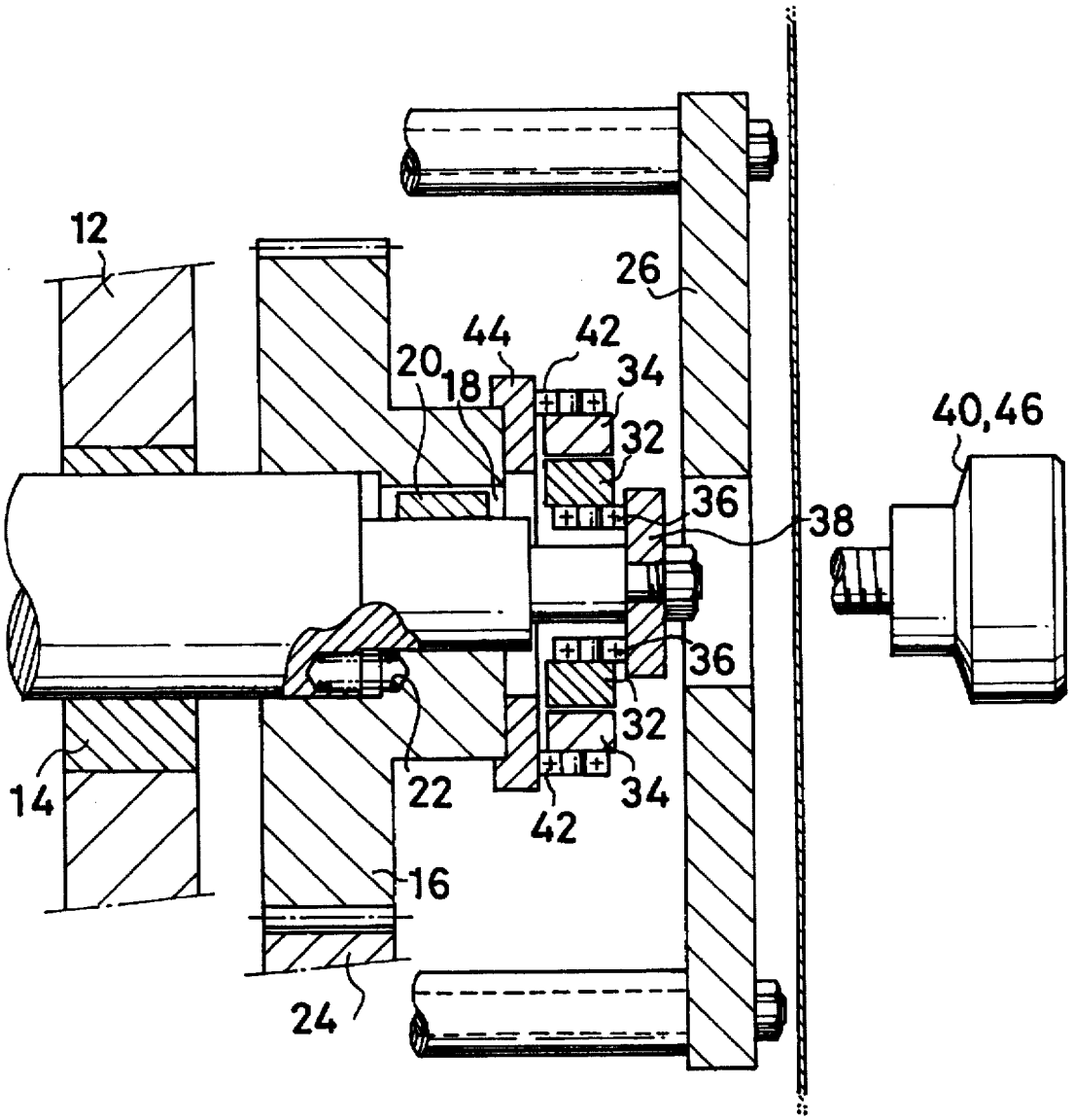
FIG. 2 is a sectional view in side elevation taken in the direction of an arrow II in FIG. 1.
Figure 3:
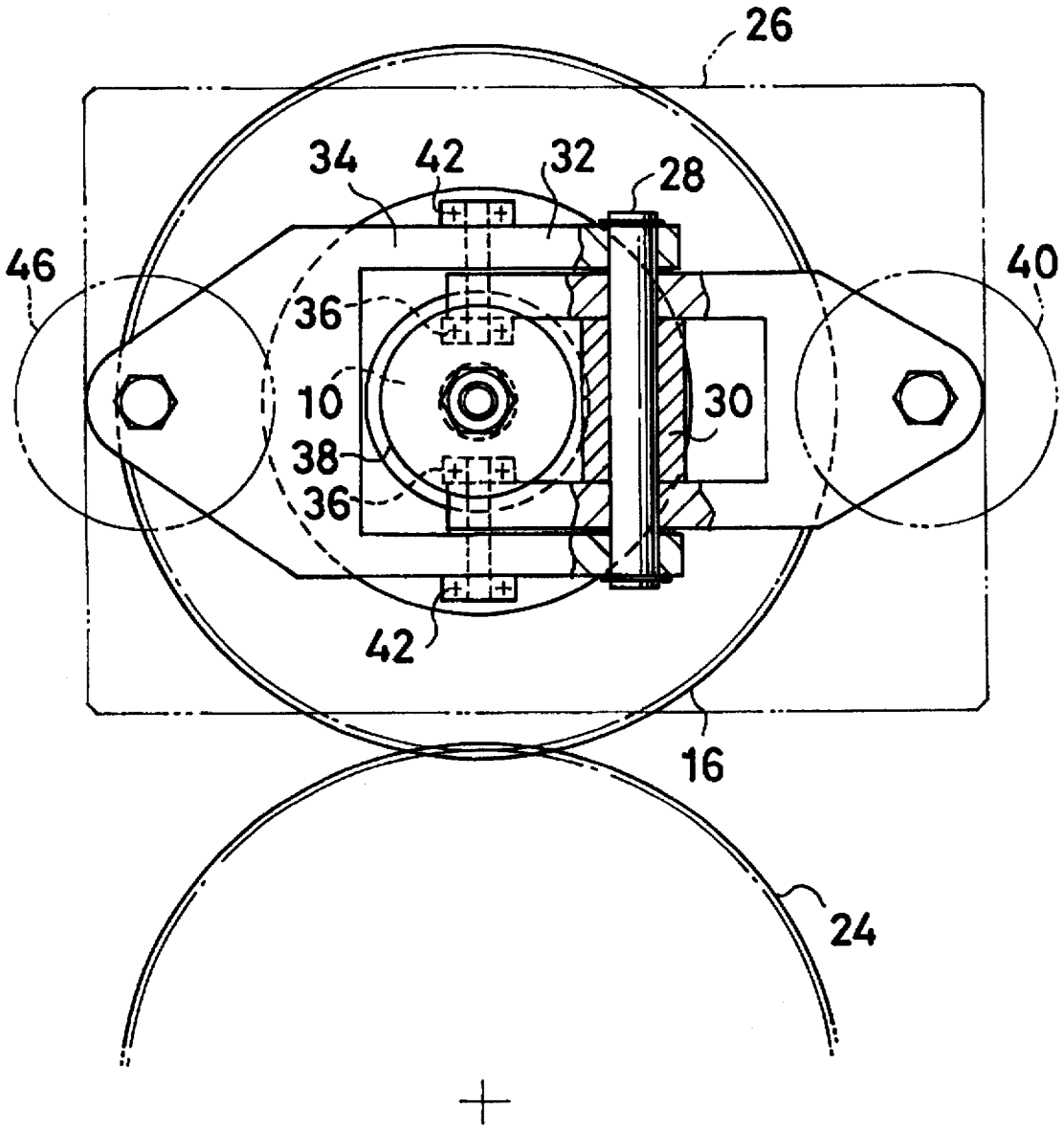
FIG. 3 is a front view taken in the direction of an arrow III in FIG. 1.
Figure 4:
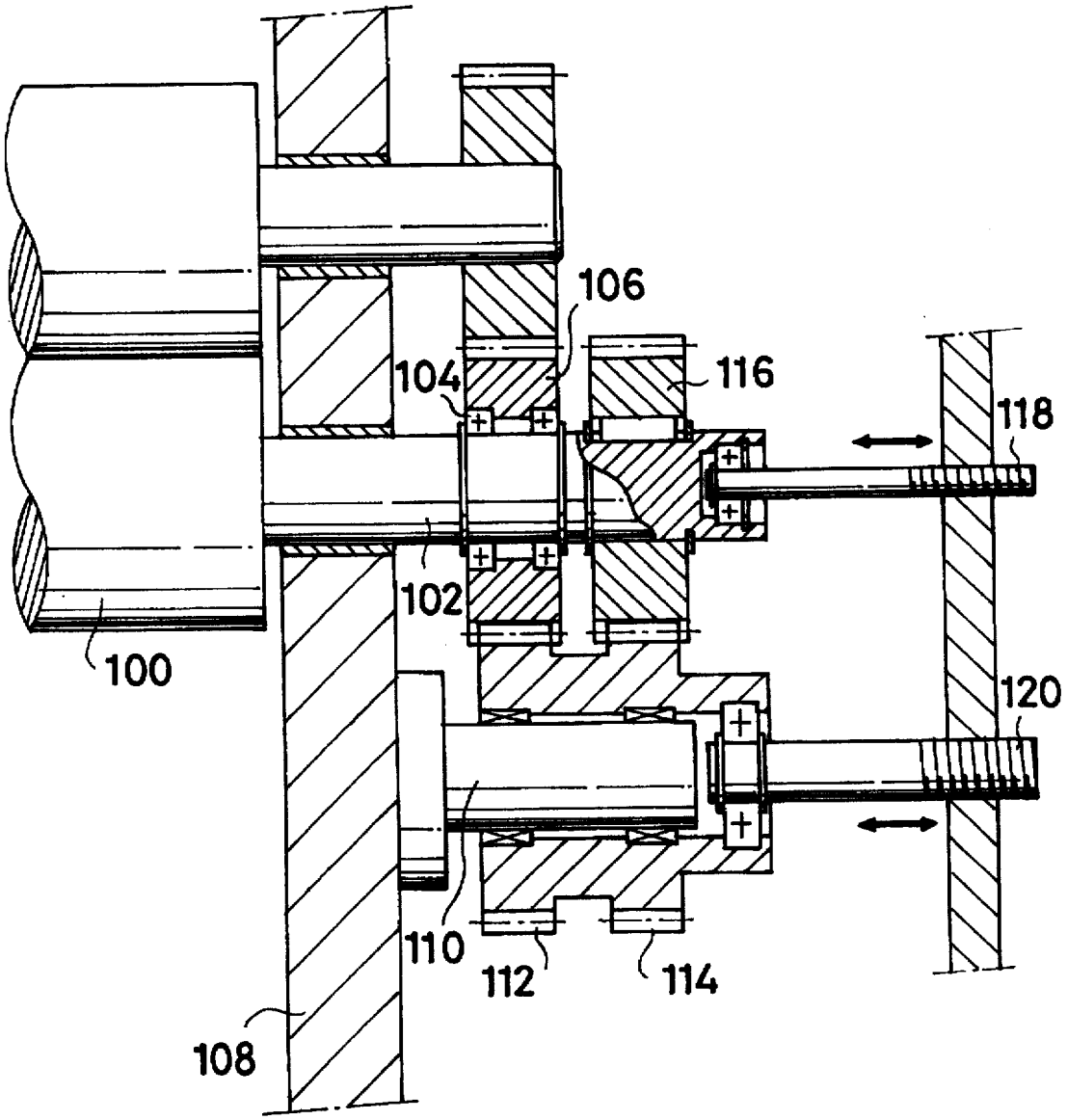
Fig. 4 PRIOR ART
FIG. 4 is a sectional view in side elevation of a conventional apparatus of this kind.

As shown in FIG. 2, one end portion of each of the first crank arms 32 are engaged with a thrust plate 38 on the cylinder shaft 10 via rollers 36 provided on the end portions thereof, and, when the crank arms 32 are turned, a thrust is applied to the cylinder shaft 10 in the axial direction thereof. A free end portion of a first thrust means 40 screwed to the mount base 26 is engaged with the other end portions of the first crank arms 32. Accordingly, when the first thrust means 40 is turned upward in FIG. 1, the first crank arms 32 is turned around the arm shaft 28. Since the first thrust means 40 works also as a kind of regulating dial, it can be easily Graduated for showing a screwing amount.

As shown in FIG. 2, the second crank arms 34 are engaged with a thrust plate 44 on a side portion of the driving gear 16 via intermediate rollers 42 thereon. When the crank arms 34 are turned around the arm shaft 28, a thrust is applied to the cylinder shaft in the axial direction thereof against the resilient force of a spring member 22. A front end portion of a second thrust means 46 screwed to the mount base 26 is engaged with the second crank arms 34 in the same manner as mentioned above. When this second thrust means 46 is screwed forward, the second crank arms 34 are turned around the arm shaft 28.

It should be noted that one end portion of each of the crank arms 32, 34 is not directly connected to the plate cylinder and driving gear 16 but engaged therewith via the rollers 36, 42 and thrust plates 38, 44. Therefore, the prevention of a movement of the plate cylinder due to the provision of the registering apparatus, which is encountered in the conventional techniques, does not occur, and the moving of the axis of the plate cylinder can be done freely as necessary, the rollers 36, 42 and thrust plates 38, 44 being able to be left engaged with each other even after the axis has been moved. In other words, the crank arms 32, 34 and the plate cylinder and driving gear 16 are in, so to speak, an indirect non-interfering relation, though the transmission of a force is carried out therebetween.

The operation of this apparatus will now be described. In order to regulate the position of the plate cylinder in the axial direction thereof, the first thrust means 40 is screwed forward with respect to the mount base 26. Consequently, the first crank arms 32 are turned around the arm shaft 28, and the rollers 36 thereon move the cylinder shaft 10 and plate cylinder in its turn in the axial direction thereof via the thrust plate 38. Such a movement of the plate cylinder results in a practical registration in the lateral direction of a sheet concerning the results of a printing operation. During this time, the driving gear 16 on the plate cylinder retains its original position as it is left meshed at its helical teeth with the helical teeth of the driving gear 24 on the blanket cylinder. It is really ascribed to the slidability of the driving gear 16 with respect to the cylinder shaft 10.

In order to adjust the position of the plate cylinder with respect to the rotational direction thereof, the second thrust means 46 is screwed forward with respect to the mount base 26. Consequently, the second crank arms 34 are turned around the arm shaft 28, and the intermediate rollers 42 thereon push the thrust plate 44 on the side portion of the driving gear 16 in the axial direction. Since both the driving gear 16 thus pushed and the driving gear 24, which is meshed therewith, on the blanket cylinder have helical teeth, the driving gear 16 and plate cylinder in its turn are rotated due to the effect of a helix angle as already known. Such a rotation of the plate cylinder results in a practical registration in the vertical direction of a sheet concerning the results of a printing operation. During this time, the driving gear 16 is rotated but the plate cylinder is not influenced thereby at all axially, so that the axial position of the plate cylinder does not vary.

According to the registering apparatus for plate cylinders of the present invention, the plate cylinder and the apparatus are in a non-interfering relation. Accordingly, the plate cylinder can be freely moved, and the construction of the apparatus does not cause an undue load to occur. Moreover, a registering operation is simple and has a high reproducibility, and the present invention therefore provides excellent registering techniques.

The present invention is not limited to the above-described embodiment but various expansions and modifications can be made.

What is claimed is:

1. A registering apparatus for plate cylinders, comprising a helical tooth-carrying driving gear (16) mounted nonrotatably and slidably on an end portion of a cylinder shaft (10) at a driving side of a plate cylinder and meshed with a helical tooth-carrying driving gear (24) on a blanket cylinder, first crank arms (32) engaged with an end portion of said shaft (10) so as to apply a thrust in the axial direction of said shaft (10) and adapted to be pushed by a first thrust means (40), and second crank arms (34) engaged with a side portion of said driving gear (16) so as to apply a thrust to said plate cylinder in the axial direction thereof and adapted to be pushed by a second thrust means (46).

* * * * *